United States Patent [19]

Mullet

[11] Patent Number: 5,036,899

[45] Date of Patent: Aug. 6, 1991

[54] PANEL GARAGE DOOR OPENING AND CLOSING

[76] Inventor: Willis J. Mullet, Pensacola, Fla.

[21] Appl. No.: 562,160

[22] Filed: Aug. 2, 1990

[51] Int. Cl.[5] ..... E05F 15/00

[52] U.S. Cl. ..... 160/189; 160/201; 49/139; 49/200; 49/358

[58] Field of Search ..... 160/189, 188, 201, 192; 74/625; 49/358, 139, 140, 200

[56] References Cited

U.S. PATENT DOCUMENTS

| | | | |
|---|---|---|---|
| 2,015,402 | 9/1935 | Johanson | 160/189 |
| 2,755,081 | 7/1956 | Johnson et al. | 160/188 |
| 3,311,159 | 3/1967 | Stansberry | 160/189 |
| 4,191,237 | 3/1980 | Voege | 160/188 |
| 4,379,479 | 4/1983 | Whiting | 160/201 |
| 4,625,456 | 12/1986 | Lafontaine | 49/358 |
| 4,732,203 | 3/1988 | Alten | 160/188 |
| 4,750,294 | 6/1988 | Lafontaine | 49/358 X |

*Primary Examiner*—David M. Purol

*Attorney, Agent, or Firm*—Mack D. Cook, II

[57] ABSTRACT

An opening-closing mechanism for a hinged panel or sectional overhead garage door which is located laterally along the top door panel and has an integrally associated electric motor and speed reduction drive component located mediate of and for a direct reaction with opposed vertical and horizontal gear and roller guide tracks having a specific curvature in the area of transition movement of door panels from vertical to horizontal.

7 Claims, 8 Drawing Sheets

FIG-6
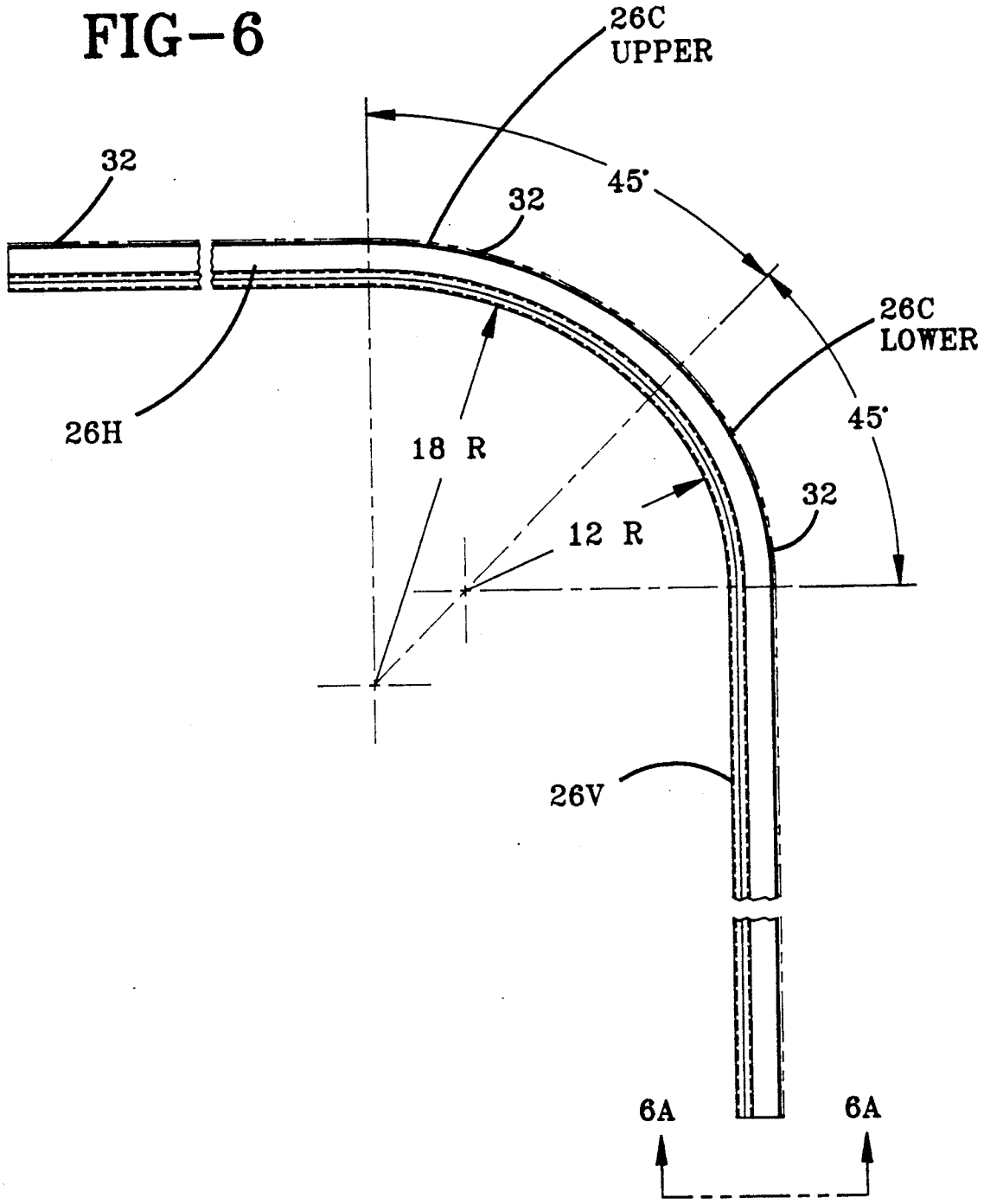
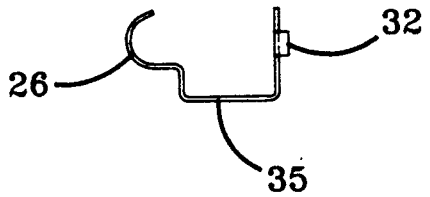
FIG-6A

PANEL GARAGE DOOR OPENING AND CLOSING

BACKGROUND OF THE INVENTION

The present invention relates to the easy installation and safe operation of a residential garage or hinged panel "overhead" door of the general style and type as earlier disclosed by two (2) patents issued to K. E. Johanson: U.S. Pat. No. 2,015,402, 9/1935 and U.S. Pat. No. 2,568,808, 9/1951.

Conventional installation of hinged panel overhead door requires a garage opening with plumb vertical jambs and a level header, work normally done by a competent construction carpenter. The installer checks the opening, which must be the same size as the door, and mounts various components of bottom section hardware on the vertical jambs and the garage ceiling behind the header. The hardware includes mounting brackets, rollers, hinges, two vertical and horizontal metal roller guide tracks, left hand and right hand, and the laterally hinged panels, four or five, of the door.

In conventional installations, the multiple hinged panels closing the garage opening are counter-balanced during opening and closing movement relative to the roller guide tracks by strong springs. The most recent counter-balance systems known to the inventor use either dual extension springs mounted above the left and right hand horizontal tracks or torsion springs mounted on the level header above the door opening.

It is known to the inventor and others familiar with the garage door industry that a counter balance system with torsion springs mounted on the level header above the door opening require that the original or professional door installer use special lever bars for adjusting door balance during opening and closing movement. Typically, accidents occur where homeowners decide to adjust or replace torsion springs as a Do-It-Yourself (DIY) home improvement project. Few homeowners have access to the special lever bars used by the professional. Such a bar is a 24" to 36" length of tempered steel that inserts through round openings in journal sleeves attached to the ends of the springs. A homeowner will often use a screwdriver. In most cases, accident victims grossly underestimate the resultant torque of the springs being wound by turning of a journal sleeve and could lose control of the screwdriver.

The inventor has determined that installation, operation and homeowner routine maintenance of a hinged panel overhead garage door will be improved by having an opening-closing or door raising and lowering mechanism which is mounted laterally along the upper most or top door panel. The opening-closing mechanism will have an integrally associated electric motor and gear reduction drive component located mediate of and for a direct reaction with opposed vertical and horizontal gear and roller guide tracks. It has been further determined that a specific curvature for opposed guide tracks in the area of transition movement of door panels from vertical to horizontal is to be preferred.

SUMMARY OF THE INVENTION

It is an object of the invention to provide an improved mechanism and components thereof for the opening-closing or raising and lowering of a hinged panel overhead garage door.

More specifically, it is an object to provide a garage door opening-closing mechanism which is located laterally along the top door panel.

Still further, it is an object to provide a garage door opening-closing mechanism with an integrally associated electric motor and gear reduction drive component located mediate of and for a direct reaction with opposed vertical and horizontal gear and roller guide tracks.

Still further, it is an object to provide a specific curvature for opposed guide tracks in the area of transition movement of door panels from vertical to horizontal.

And still further, it is an object to provide an elect motor and drive component which may be installed on the top door panel intermediate and between laterally directed elements of the opening-closing mechanism.

These and other objects of the invention, as well as the operating efficiencies and advantages thereof, will be apparent in view of the following drawings and specification.

In general, the invention is used adjacent a structurally framed garage opening and includes a hinged multiple panel overhead door, horizontal, corner and vertical segments of opposed roller guide tracks, and a panel door opening-closing mechanism.

The door opening-closing mechanism has an integrally associated electric motor and drive component located mediate of and for a direct reaction with opposed guide tracks and is located along and across the upper most or top door panel. Each guide track has a face with an elongate gear rack. Each gear rack is in continuous meshing engagement with a driven gear at an onboard end of the mechanism. Each gear is driven by operator actuation of the drive component. And, each mechanism further has an idler roller bearing and a driven gear confined and guided within an outer channel on each guide track.

Use of the invention also contemplates that the driven gears and idler roller bearings of a door opening-closing mechanism will be for the most part of their movement by the electric motor and drive component in contact with horizontal segments and only approximately 120 degrees into corner segments of opposed guide tracks.

IN THE DRAWINGS:

FIG. 6 is a plan view showing a specific curvature for the roller guide tracks according to the invention;

FIG. 6A is a cross-section of a roller guide track taken substantially as indicated on line 6A—6A of FIG. 6;

DETAILED DESCRIPTION OF THE INVENTION

Figure 1:
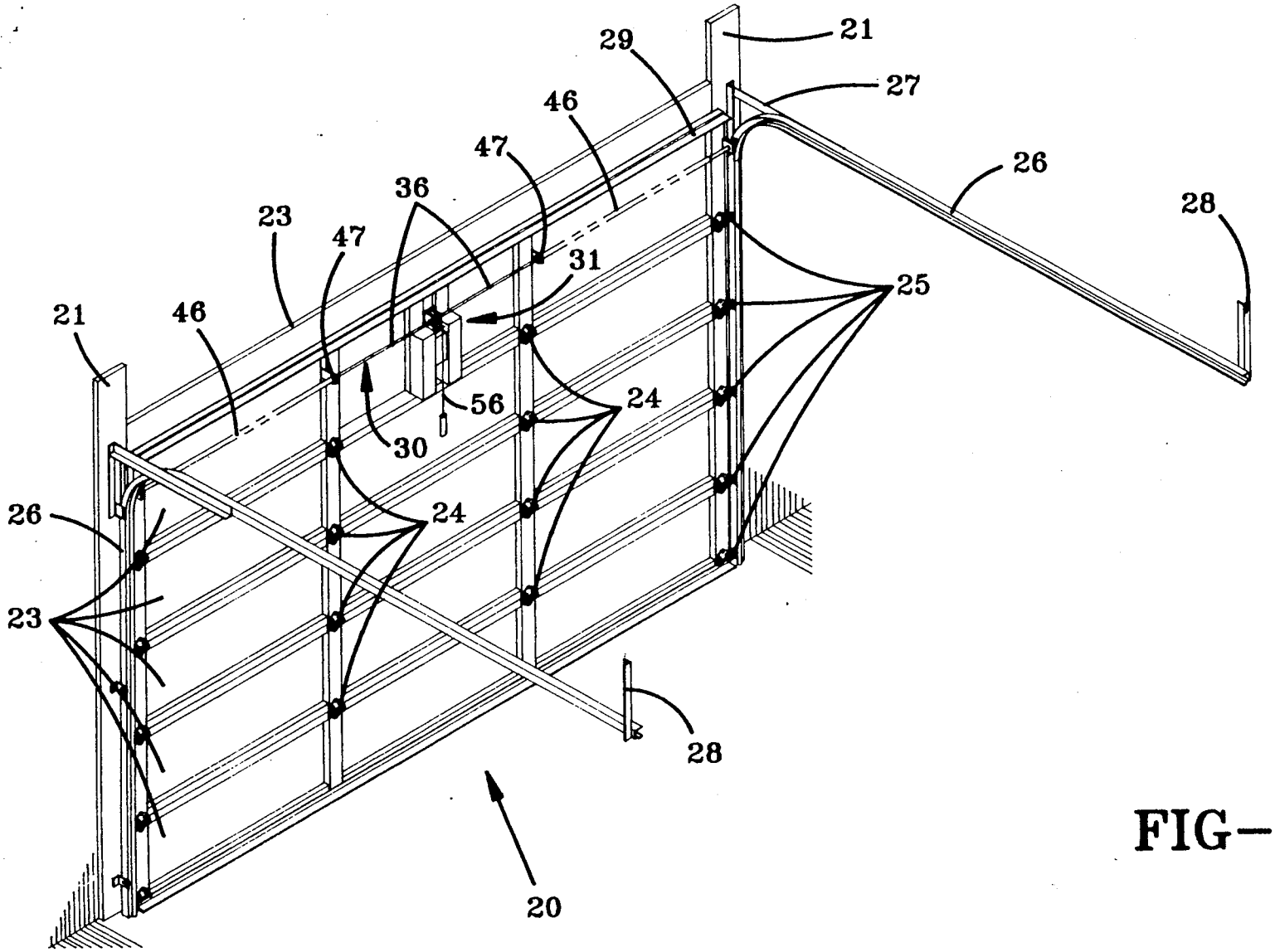
FIG. 1 is an isometric perspective showing the interior of a garage having an opening closed by an overhead door installation according to the invention.

Referring to FIG. 1, a door referred to generally by the numeral 20 is used to open-close a garage opening structurally framed with plumb vertical jambs 21 and a level header 22. A door 20 will have multiple panels indicated by the numeral 23, interconnected by sets of inwardly facing hinges 24. As shown, five (5) door panels 23 are interconnected by four (4) sets of four (4) hinges 24. The lower outside of each panel 23 will mount an idler roller indicated by the numeral 25. The idler rollers 25 will guide the door panels 23 during movement within two opposite hand vertical and horizontal roller guide tracks indicated by the numeral 26.

Each roller guide track 26, which is a novel component for the invention as described in detail below, is mounted on a vertical jamb 21 as by an angle bracket 27 and to the garage interior (not shown) as by a strap bracket 28. If desired, any opening between the door 20 when closed and the header 22 may be sealed off by an elongate closure panel 29.

According to the invention, a door 20 is open-closed by a mechanism referred to generally by the numeral 30 located laterally along and across the upper most or top door panel 23.

As shown in FIG. 1, a door opening-closing mechanism 30 has an integrally associated electric motor and speed reduction drive component 31 located mediate of and for a direct reaction with opposed roller guide tracks 26.

Figure 2:
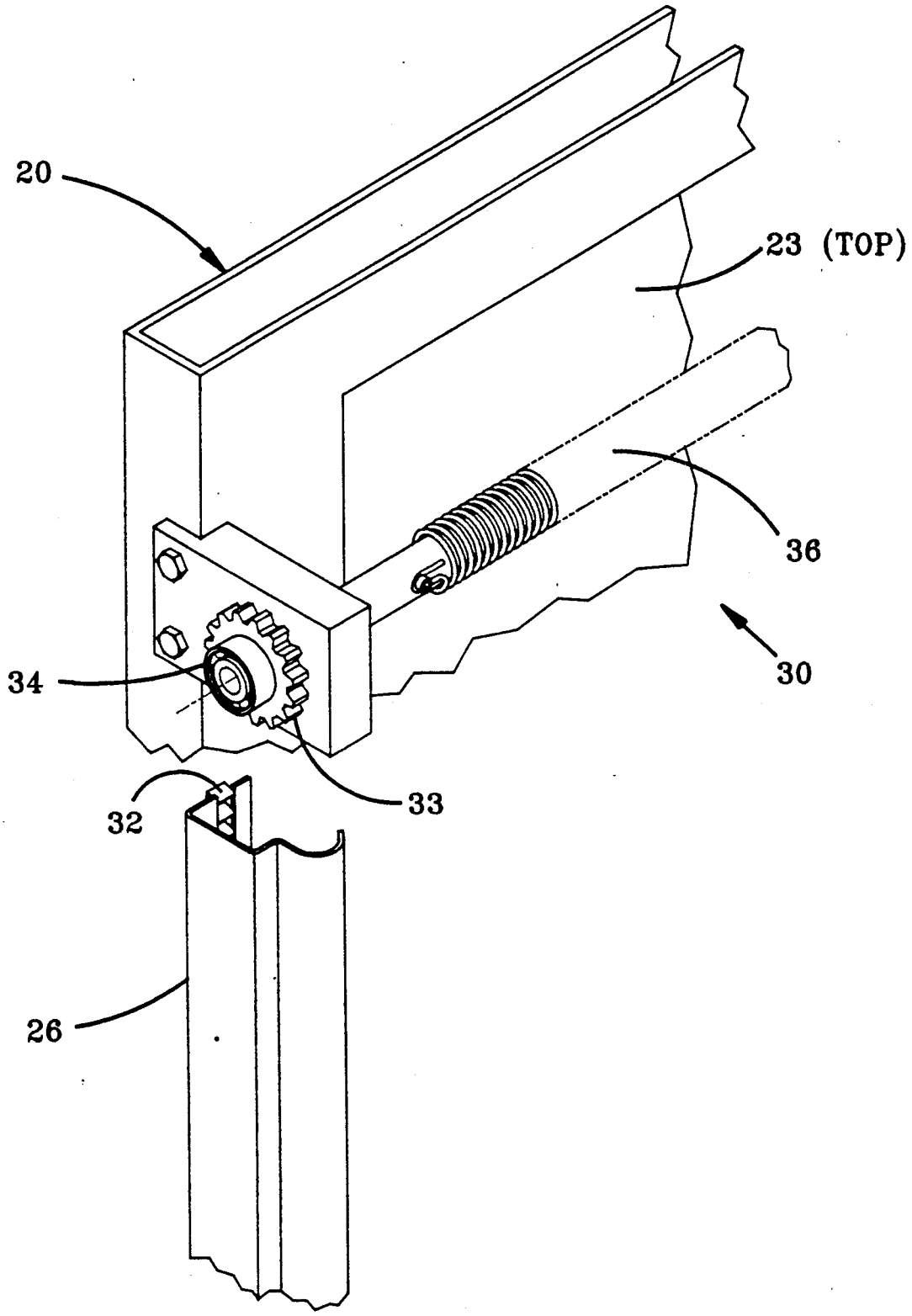
FIG. 2 is an enlarged exploded view showing details for the door opening mechanism of FIG. 1.
Figure 3:
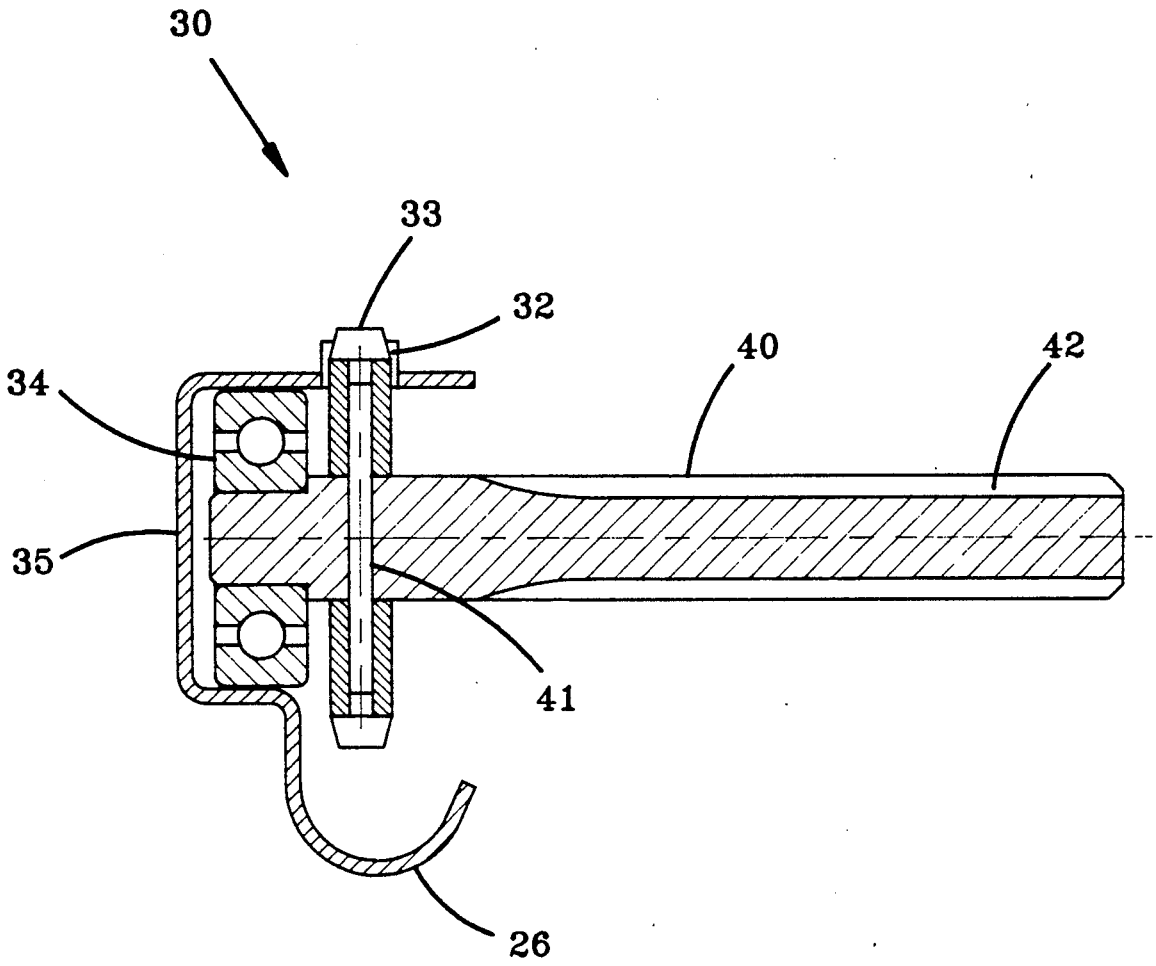
FIG. 3 is a further enlarged sectional view of elements for the mechanism of FIG. 2.

Referring to FIGS. 2 and 3, each roller guide track 26 has an outer face with an elongate gear rack 32. Each gear rack 32 is in continuous meshing engagement with a driven gear 33 at an outboard end of a mechanism 30. Each gear 33 is selectively rotated by operator actuation of the electric motor drive component 31. A mechanism 30 further has an idler roller bearing 34 outboard of a gear 33 and confined and guided during opening-closing movement of a door 20 within a generally C-shaped outer channel 35 on each roller guide track 26.

Figure 8:
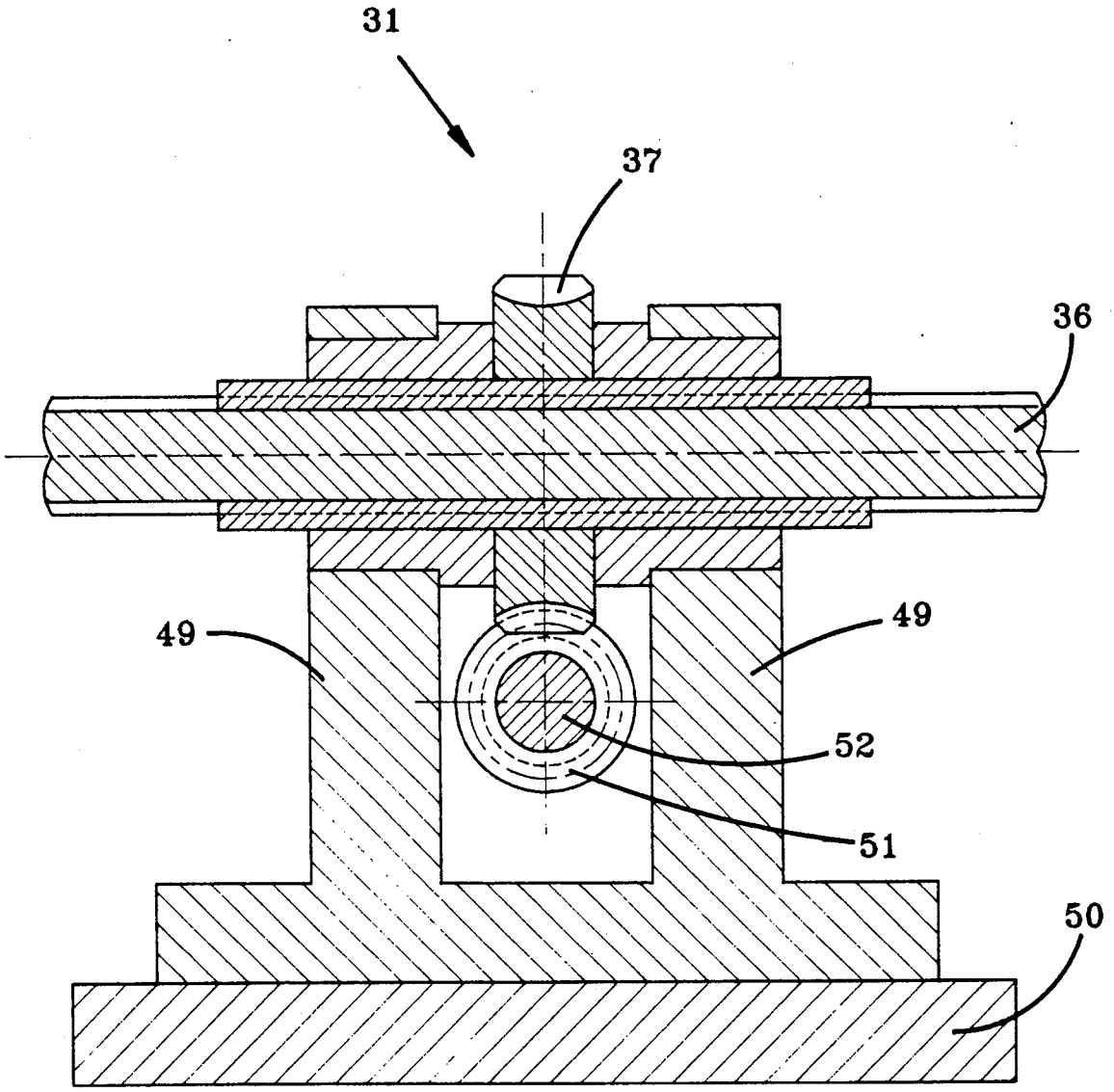

As best shown in FIGS. 1 and 8, the elements of a mechanism 30 include an elongate metal tube and linear drive shaft 36 having a length such as to extend substantially the full width of a door panel 23. At substantially the middle of the upper most or top panel 23, the drive shaft 36 carries and mounts a power gear 37 selectively rotated by the electric motor drive component 31.

Figure 4:
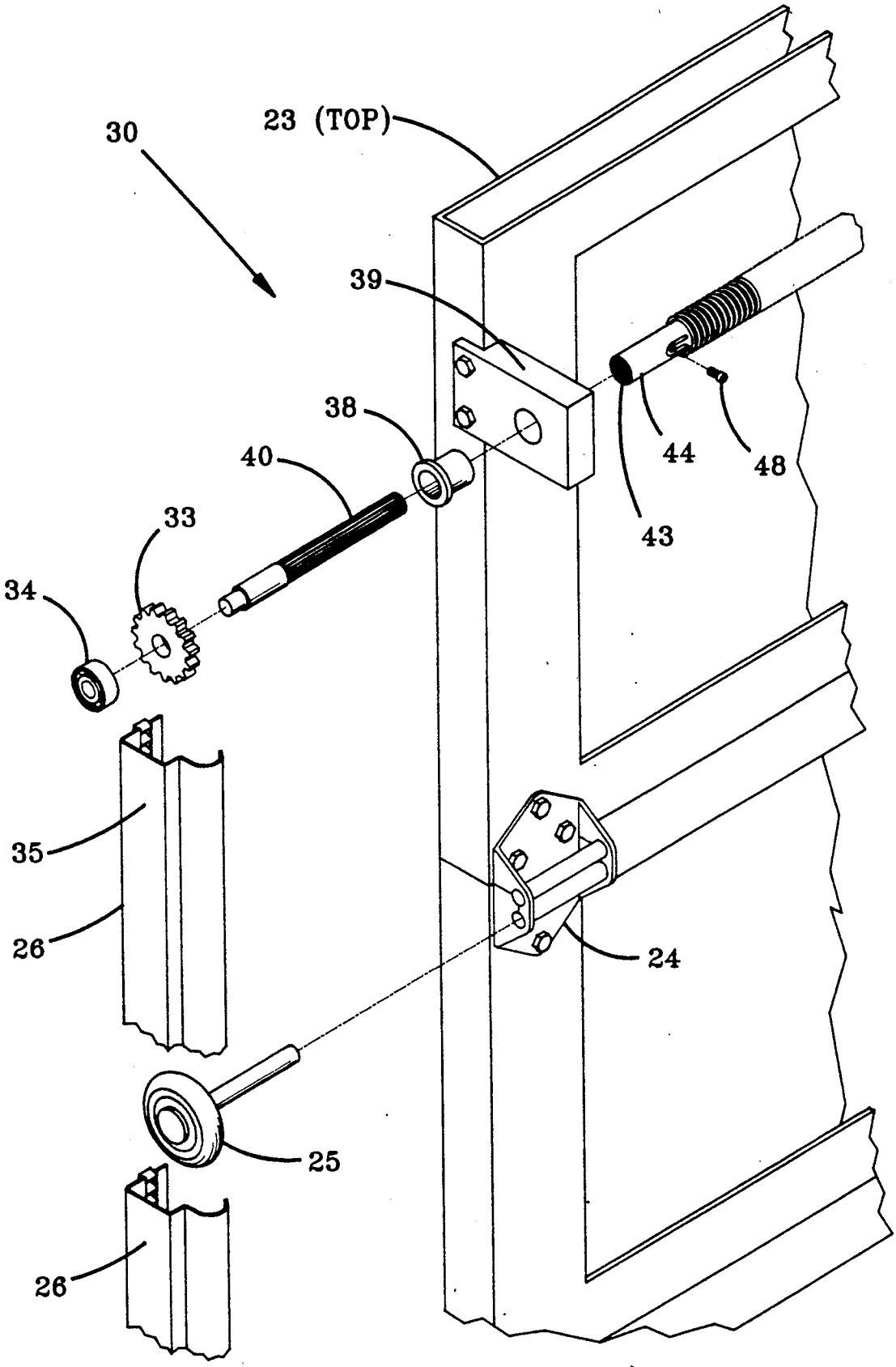
FIG. 4 is another enlarged exploded view of elements for the opening-closing mechanism according to the invention.
Figure 5:
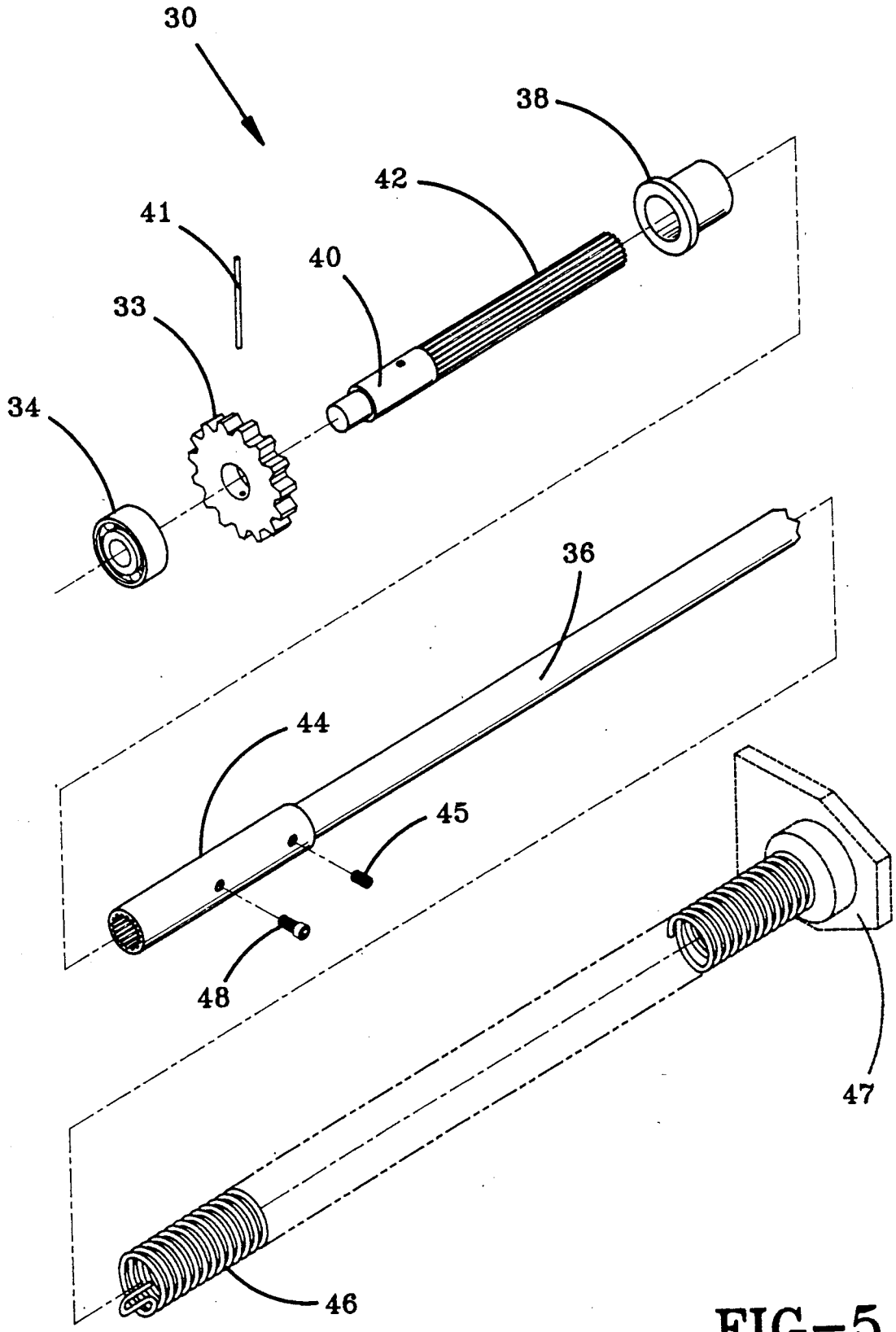
FIG. 5 is another exploded view of elements for the mechanism of FIG. 4.

Referring to FIGS. 4 and 5, each outboard end of the linear drive shaft 36 is journaled within a low-friction bushing 38 carried by a mounting bracket 39 affixed to the upper most or top door panel 23. Each projecting end of a drive shaft 36 is adapted to receive and mount a short axle shaft 40.

Referring to FIG. 3, each axle shaft 40 has an outer end machined to mount and seat the inner race of a roller bearing 34. A driven gear 33 is attached inwardly of a bearing 34 to the axle shaft 40 as by a pin 41 for meshing engagement with the elongate gear rack 32 on each guide track 26.

Referring to FIGS. 3, 4 and 5, each axle shaft 40 preferably has exterior splines 42 for sliding engagement with mating interior splines 43 on a drive coupler sleeve 44. As shown, each coupler sleeve 44 is telescoped around an outboard end of a linear drive shaft 36 and secured thereto by a removable fastener or screw 45. The sliding splines 42 and 43, and the lateral movement of a coupler sleeve 44 when a screw 45 is removed, facilitate routine maintenance of components of a mechanism 30, including precise positioning of the driven gears 33 relative to a guide track elongate gear rack 32.

As an additional advantage, a mechanism 30 also has coil springs 46 which are wound or tensioned during closing and lowering a door 20 so as to aid in opening and raising a door 20 in the event electrical power to the drive component 31 is interrupted. As shown in FIGS. 1, 2, 4 and 5, a coil spring 46 may be fitted around each half portion of a linear drive shaft 36. The inboard end of each spring 46 may be secured as by attachment to a drive shaft support bracket 47, suitably spaced on the top door panel 23 laterally away from the electric drive motor component 31. The outboard end of each coil spring 46 may be secured as by attachment to a coupler sleeve 44 by a fastener 48.

Figure 7:
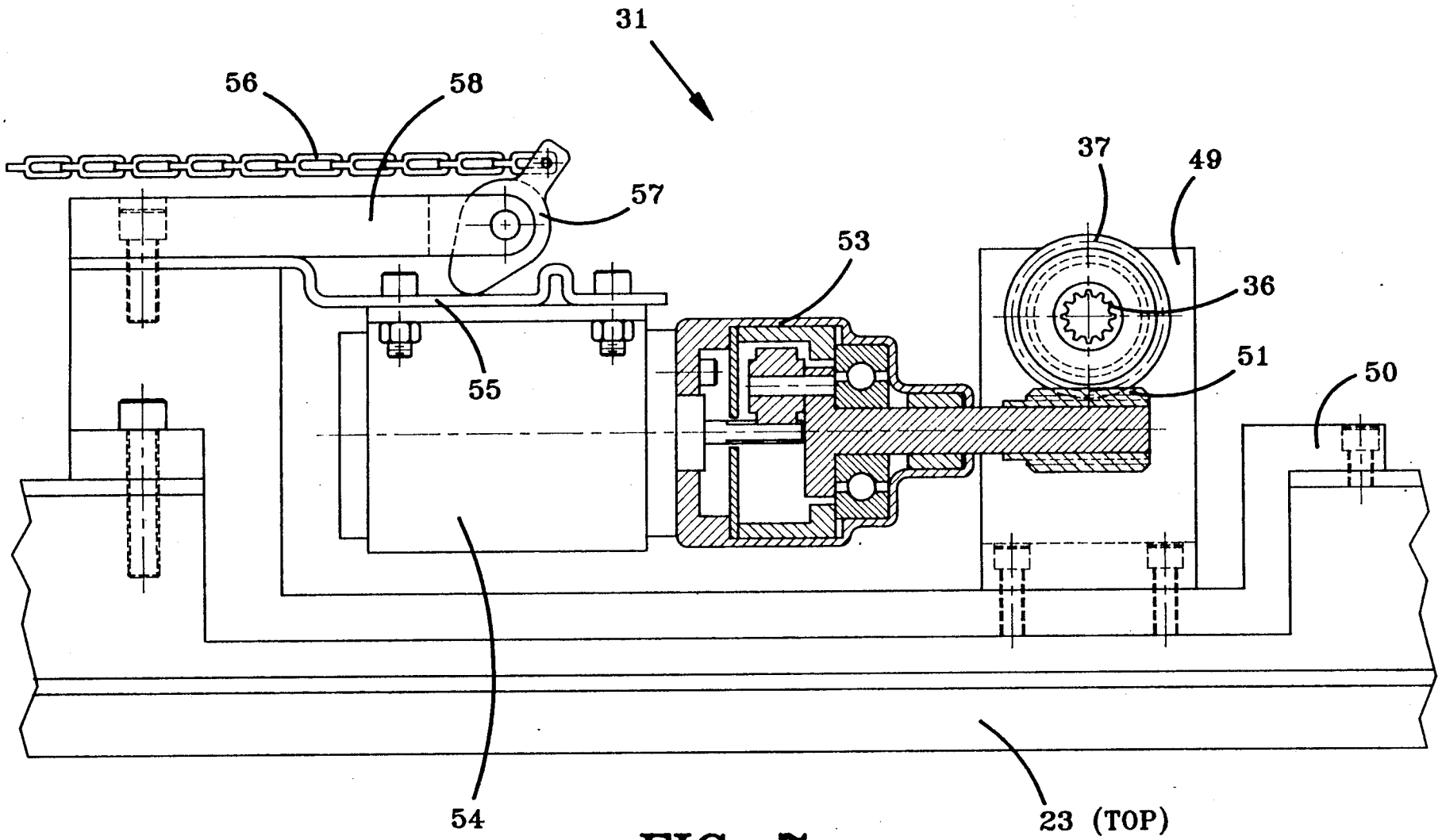
FIG. 7 is a plan view of partial section showing details of the e motor and drive component for the overhead door installation of FIG. 1; and, FIG. 8 is a section showing mounting of the power transmission elements of FIG. 7.

Referring generally to FIG. 1, and specifically to FIGS. 7 and 8, at or near the midpoint and mediate of the upper most or top panel 23 the linear drive shaft 36 is stabilized by a stanchion 49 which is suitably connected to a door panel mounting plate 50. Within the stanchion 49, a power gear 37 is connected to the drive shaft 36 for selective rotation by power from the drive component 31. The drive shaft power gear 37 meshes with a worm drive gear 51 mounted on the output shaft 52 from a speed reducer 53 driven by a low voltage (e.g. 24 volt) reversible electric motor 54.

The mounting of elements 51, 52, 53 and 54 of drive component 31 of a mechanism 30 at or near the midpoint of a top panel 23 and mediate between the opposed roller guide tracks 26 will provide another advantage in the event of loss of electric power such as to require human opening of a door 20. As shown in FIG. 7, the motor 54 is mounted on a resilient moderately flexible or slightly bendable plate 55 between stanchions 49 and extending upwardly from a door panel mounting plate 50. The resilient plate 55 is movable to disengage the worm gear 51 from the power gear 37 by a human selectively pulling on a chain 56. A human pulling down on the chain 56 will actuate a rotatable cam 57 carried at the end of a cam bracket 58 to move the worm gear 51 away from the power gear 37. The resultant disengagement of the worm gear 51 and power gear 37, assisted by the energy stored in the coil springs 46, will enable a human to open a closed door 20.

It has been found that transition movement of the top door panel 23 during opening-closing of a door 20 will be improved when the roller guide tracks 26 which engage the driven gears 33 roller bearings 34 of a mechanism 30 are provided with the specific curvature or corner bend as defined with reference to FIG. 6.

FIG. 6 displays dimensional factors to be used during fabrication of guide tracks 26 prior to installation of a door 20 and an opening-closing mechanism 30 in a construction carpenter prepared garage opening. Each track 26 is considered as having a vertical segment 26V, a corner or bend segment 26C and a horizontal segment 26H. A track 26 is initially formed in a roller or extrusion die (not shown) as a linear element. Then, a cut-to-length segment of a straight track 26 is placed in a bending die (not shown). The fabrication bending die for a track 26 will form a 45 degree lower quadrant on a twelve inch (12") radius and a 45 degree upper quadrant on an eighteen inch (18") radius.

Bending the corner 26C of a guide track according to FIG. 6 will provide, that the driven gears 33 and roller bearings 34 of a mechanism 30 travel in the horizontal track segment 26H for the most part of their movement and only approximately 120 degrees into the corner segment 26C; at no time moving into the vertical segment 26V and therefore increasing the useful life and the operating efficiency of a mechanism 30 mounted along and across the upper most or top panel 23 of a door 20.

What is claimed is:

1. A hinged multiple panel overhead door, horizontal, corner and vertical segments of opposed roller guide tracks, and a door opening-closing mechanism:

said opening-closing mechanism being installed along and across the uppermost or top panel of said door and having an integrally associated electric motor and drive component located mediate of said opposed guide tracks for a direct reaction with said horizontal and corner segments of said guide tracks through a linear drive shaft extending between said guide tracks;

each said guide track having an outer face with an elongate gear rack;

each said gear rack being in continuous meshing engagement with a driven gear at an outboard end of said linear drive shaft; and, said opening-closing mechanism further having an idler roller bearing and one of said driven gears confined and guided within an outer channel on each said guide track during operation thereof.

2. Roller guide tracks according to claim 1, wherein said elongate gear rack is on the outer face of said horizontal and corner segments thereof, and said corner segments have a 45 degree lower quadrant on a twelve inch (12") radius and a 45 degree upper quadrant on an eighteen inch (18") radius.

3. An opening-closing mechanism according to claim 1, wherein said linear drive shaft at substantially the middle of said top panel carries and mounts a power gear selectively rotated by said electric motor and drive component.

4. An opening-closing mechanism according to claim 3, wherein an outboard portion of said linear drive shaft is journaled on said top panel and each projecting end of said drive shaft mounts an axle shaft, and the inner race of each said idler roller bearing is mounted on an axle shaft and each said driven gear is attached to an axle shaft inwardly of a roller bearing.

5. An opening-closing mechanism according to claim 3, wherein coil springs are located around said linear drive shaft on opposite sides of said power gear and wound or tensioned during closing and lowering of said door.

6. An opening-closing mechanism according to claim 3, wherein said power gear is positioned within a stanchion connected to substantially the middle of said top panel, and within said stanchion said power gear meshes with a worm drive gear mounted on the output shaft from said electric motor and drive component, and said electric motor and drive component is mounted adjacent said stanchion on a resilient moderately flexible plate selectively movable to disengage said power gear from said worm drive gear.

7. An opening-closing mechanism according to claim 4, wherein each said axle shaft has exterior splines for sliding engagement with mating interior splines on a drive coupler sleeve, and each said coupler sleeve is telescoped around an outboard portion of said linear drive shaft and secured thereto by a removable fastener.

* * * * *